US009261324B1

(12) United States Patent
Liang et al.

(10) Patent No.: US 9,261,324 B1
(45) Date of Patent: Feb. 16, 2016

(54) BUTTSTOCK STRUCTURE FOR A TOY GUN

(71) Applicant: VEGA FORCE INTERNATIONAL CORP., New Taipei (TW)

(72) Inventors: Hsin-Ting Liang, New Taipei (TW); Wei-Hung Chung, New Taipei (TW); Shih-Che Kung, New Taipei (TW)

(73) Assignee: VEGA FORCE INTERNATIONAL CORP., New Taipei (TW)

( * ) Notice: Subject to any disclaimer, the term of this patent is extended or adjusted under 35 U.S.C. 154(b) by 0 days.

(21) Appl. No.: 14/805,720

(22) Filed: Jul. 22, 2015

(51) Int. Cl.

| | |
|---|---|
| ***F41C 23/14*** | (2006.01) |
| ***F41C 23/00*** | (2006.01) |
| ***F41C 23/04*** | (2006.01) |
| ***F41B 11/00*** | (2013.01) |

(52) U.S. Cl.
CPC ..... *F41C 23/14* (2013.01); *F41B 11/00* (2013.01); *F41C 23/04* (2013.01)

(58) Field of Classification Search
CPC ..... F41C 23/14; F41C 23/04; F41B 11/00
USPC ..... 42/71.01, 73, 75.01, 75.03
See application file for complete search history.

(56) References Cited

U.S. PATENT DOCUMENTS 3,137,958 A * 6/1964 Lewis ..... F41C 23/14 42/73
3,348,328 A * 10/1967 Roy ..... F41C 23/04 42/73
5,173,564 A * 12/1992 Hammond, Jr. ..... F41C 23/00 42/75.03
6,553,707 B1 * 4/2003 Tseng ..... F41C 23/12 124/27
6,560,911 B2 * 5/2003 Sharp ..... F41C 23/14 42/72
6,637,141 B1 * 10/2003 Weatherby ..... F41C 23/06 42/75.03
6,651,371 B2 * 11/2003 Fitzpatrick ..... F41C 23/04 42/71.01
6,688,031 B2 * 2/2004 Steele ..... F41C 23/14 42/71.01
6,732,466 B2 * 5/2004 Bentley ..... F41C 23/04 42/74
6,779,289 B2 * 8/2004 Kay ..... F41C 23/22 42/72
7,162,822 B1 * 1/2007 Heayn ..... F41C 23/04 42/71.01
7,398,616 B1 * 7/2008 Weir ..... F41C 23/04 42/71.01
7,428,794 B2 * 9/2008 Oz ..... F41A 23/02 42/73
7,640,688 B2 * 1/2010 Oz ..... F41C 23/14 42/71.01
7,717,024 B2 * 5/2010 Steimke ..... F41A 3/50 89/126
7,762,018 B1 * 7/2010 Fitzpatrick ..... F41A 11/02 42/73
7,793,453 B1 * 9/2010 Sewell, Jr. ..... F41C 23/04 42/73
7,823,313 B2 * 11/2010 Faifer ..... F41C 23/06 42/1.06

(Continued)

*Primary Examiner* — Alexander Niconovich
(74) *Attorney, Agent, or Firm* — Chun-Ming Shih; HDLS IPR Services

(57) ABSTRACT

A buttstock structure is used in a toy gun, for collaborating with a gun body. The gun body includes an extension member connected to the gun body. The extension member is formed with a plurality of retaining troughs. The buttstock structure includes a buttstock body and an adjusting trigger. The buttstock body includes a chamber accommodating the extension portion, a latch selectively engaged with a respective one of the retaining troughs, and a latch recess accommodating the latch. A retaining pin is inserted in the latch and protrudingly disposed on a side wall of the latch recess. An adjusting trigger is movably connected with the buttstock body. The adjusting trigger includes a handle and a linking member connected to the handle. Two inclined slots for containing the retaining pin are formed at one end of the linking member.

15 Claims, 11 Drawing Sheets

(56) References Cited

U.S. PATENT DOCUMENTS

| | | | | |
|---|---|---|---|---|
| 7,849,626 | B2 * | 12/2010 | Fluhr | F41C 23/04 42/73 |
| 7,930,849 | B2 * | 4/2011 | Abraham | F41C 23/14 42/73 |
| 7,984,580 | B1 * | 7/2011 | Giauque | F41C 23/06 42/73 |
| 8,127,483 | B2 * | 3/2012 | Kincel | F41C 23/04 42/71.01 |
| 8,186,090 | B1 * | 5/2012 | Chiarolanza | F41C 23/04 42/73 |
| 8,327,569 | B2 * | 12/2012 | Kincel | F41C 23/04 42/71.01 |
| 8,341,868 | B2 * | 1/2013 | Zusman | F41C 23/22 42/73 |
| 8,356,542 | B2 * | 1/2013 | Cottle | F41A 19/11 42/69.01 |
| 8,397,414 | B2 * | 3/2013 | Walters | F41C 23/04 42/71.01 |
| 8,434,252 | B2 * | 5/2013 | Holmberg | F41A 3/84 42/1.06 |
| 8,555,541 | B2 * | 10/2013 | Ingram | F41A 11/00 42/71.01 |
| 8,677,669 | B1 * | 3/2014 | Vesligaj | F41C 23/04 42/71.02 |
| 8,800,189 | B2 * | 8/2014 | Fitzpatrick | F41C 23/06 42/71.01 |
| 8,844,185 | B2 * | 9/2014 | Jarboe | F41C 23/04 42/73 |
| 8,950,099 | B2 * | 2/2015 | Rogers | F41C 23/04 42/71.01 |
| 8,955,245 | B2 * | 2/2015 | Chvala | F41C 23/14 42/1.06 |
| 8,978,284 | B1 * | 3/2015 | Zusman | F41C 23/14 42/1.06 |
| 8,978,285 | B1 * | 3/2015 | Burke | F41C 23/14 42/73 |
| 8,984,791 | B1 * | 3/2015 | Leslie | F41C 23/04 42/71.01 |
| 9,109,855 | B1 * | 8/2015 | Kincel | F41C 23/20 |
| 9,121,663 | B2 * | 9/2015 | Troy | F41C 23/14 |
| 9,146,071 | B2 * | 9/2015 | Liu | F41B 5/1403 |
| 2006/0010749 | A1 * | 1/2006 | Kincel | F41C 23/22 42/71.01 |
| 2007/0261284 | A1 * | 11/2007 | Keng | F41C 23/04 42/73 |
| 2009/0255161 | A1 * | 10/2009 | Fitzpatrick | F41C 27/00 42/90 |
| 2010/0275489 | A1 * | 11/2010 | Cabahug | F41C 23/22 42/71.01 |
| 2013/0097911 | A1 * | 4/2013 | Larue | F41C 23/04 42/73 |
| 2014/0096757 | A1 * | 4/2014 | Larmer | F41B 11/52 124/73 |
| 2015/0052795 | A1 * | 2/2015 | Burke | F41C 23/14 42/71.01 |

* cited by examiner

BUTTSTOCK STRUCTURE FOR A TOY GUN

TECHNICAL FIELD

The present invention relates to a buttstock structure for a toy gun and, in particular, to a length adjustable buttstock structure for a toy gun.

BACKGROUND

When using airsoft guns, the size and shape of the face of each player is not the same, and consequently, the airsoft guns may not contact the face properly to well support the face. In addition, since each player has different gripping methods and habits, a buttstock has to be adjusted to a suitable length so that the buttstock may contact against the chest of the player when the airsoft gun is changed to a rifle. There are conventional length adjustable buttstock structures in the market. The conventional length adjustable buttstock structure is operated by two elements: a handle and a fastening structure. When to extend the buttstock, first the fastening structure is released to separate the buttstock structure from a barrel (which typically called "Buffer Tube"), then the handle is pressed to make the buttstock away from a gear portion in the barrel, and thereby extension or shorten of the buttstock is completed (the foregoing descriptions relate to the known length adjustable buttstock structures in the market). Although the length of the buttstock can be adjusted using the aforesaid structure, the structure is complicate and has too many components, thereby resulting in high assembling and production costs and other problems.

In view of the foregoing, the inventor made various studies to improve the above-mentioned problems by providing a simple structure to adjust the buttstock or a cheek piece, so as to enhance the practical utility in the industries.

SUMMARY

It is an object of the present invention to provide a buttstock structure for a toy gun, which has a simple structure and can be adjusted readily and quickly.

Accordingly, the present invention provides a buttstock structure for a toy gun, for collaborating with a gun body. The gun body comprises an extension member connected to the gun body. The extension member is formed with a plurality of retaining troughs. The buttstock structure includes a buttstock body and an adjusting trigger. The buttstock body includes a chamber accommodating the extension portion, a latch selectively engaged with a respective one of the retaining troughs, and a latch recess accommodating the latch, wherein a retaining pin is inserted in the latch and protrudingly disposed on a side wall of the latch recess. The adjusting trigger is movably connected with the buttstock body. The adjusting trigger includes a handle and a linking member connected to the handle. Two inclined slots for containing the retaining pin is formed at one end of the linking member. When the adjusting trigger moves away from the latch, the retaining pin moves along the two inclined slots to drive the latch to be removed from the retaining trough, and thereby the buttstock body is moved with respect to the extension portion.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 1:
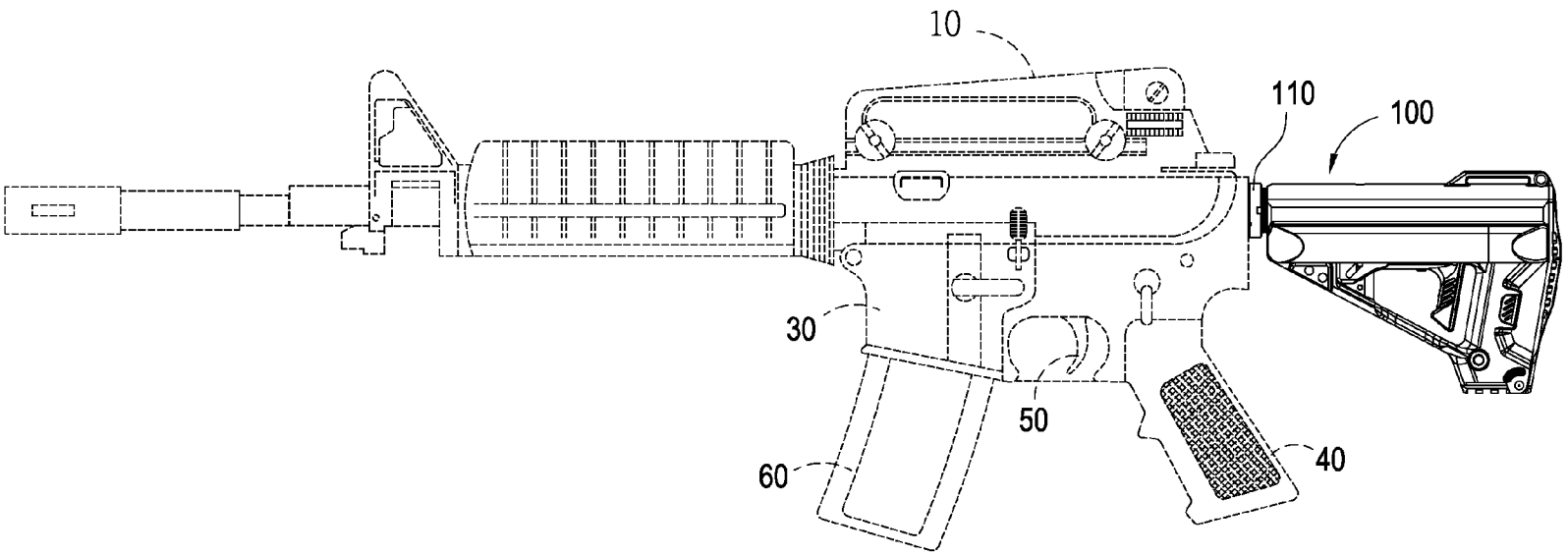
FIG. 1 is a schematic view illustrating a buttstock structure collaborating with a gun body according to the present invention.
Figure 2:
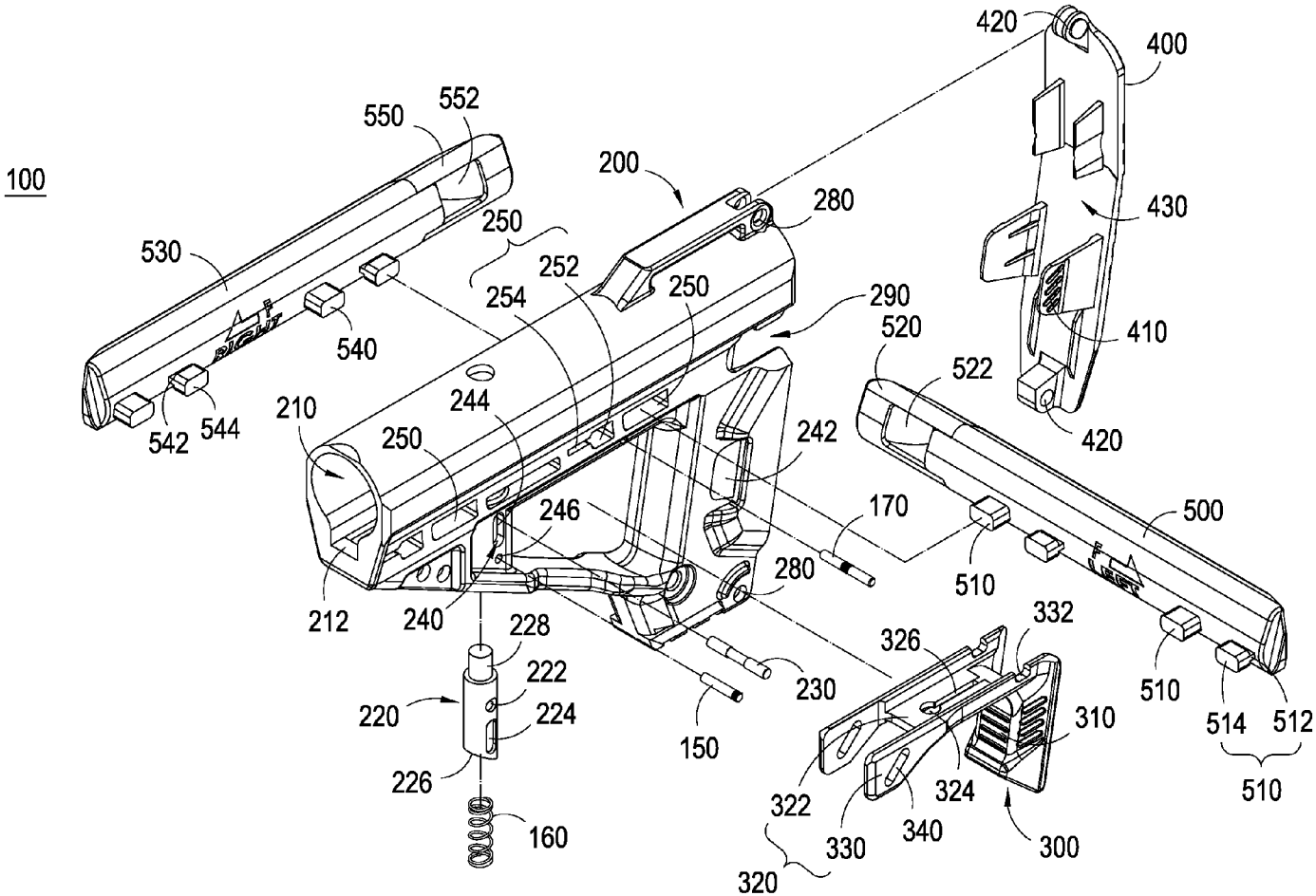
FIG. 2 is an exploded view illustrating the buttstock structure according to the present invention.
Figure 3:
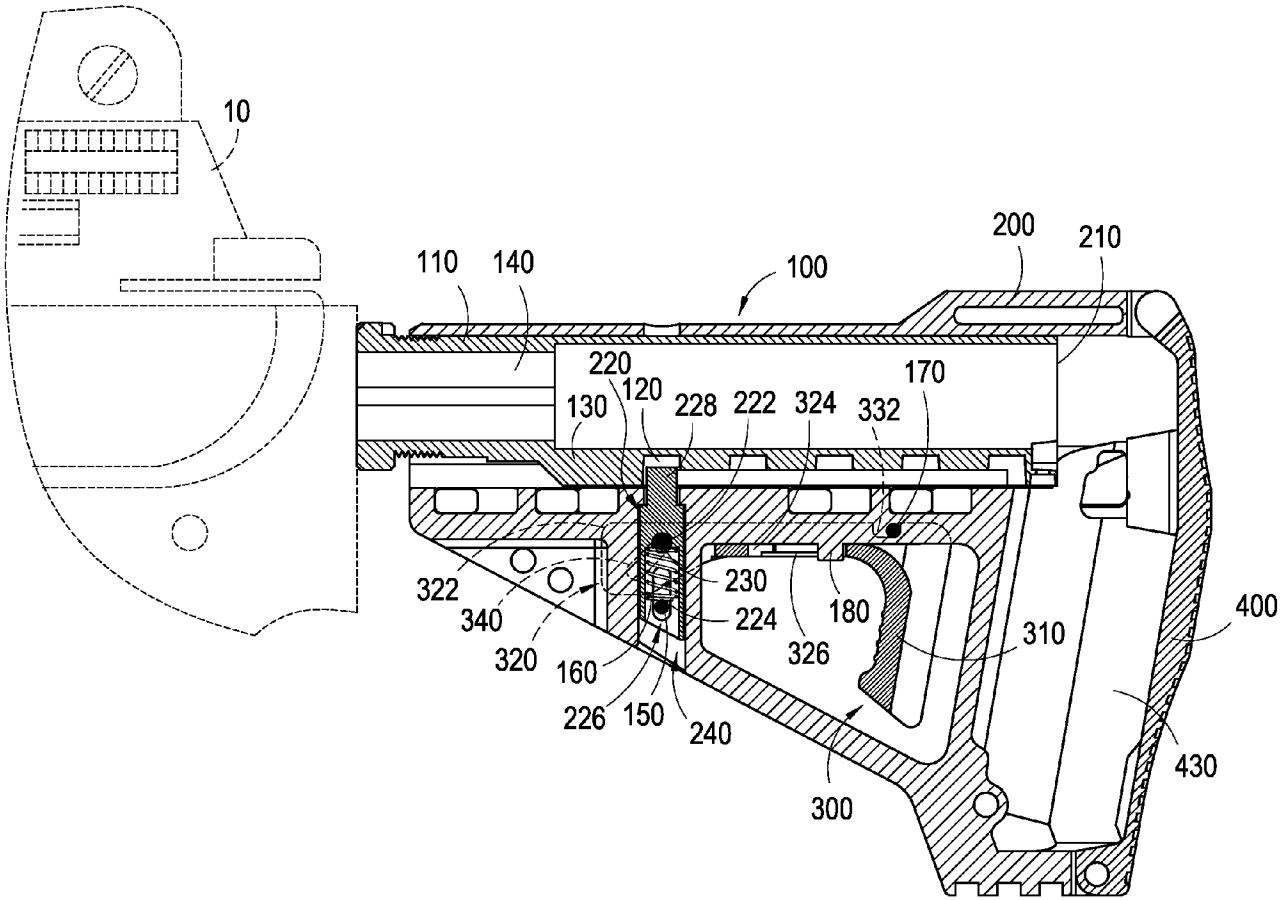
FIG. 3 is an operating view of the present invention, showing the adjusting trigger operated to detach the latch from a retaining trough of an extension member.

Referring to FIG. 1 to FIG. 3, a buttstock structure for a toy gun is provided for collaborating with a gun body 10 according to the present invention. The gun body 10 as referred herein includes a housing 30 enclosing a barrel 20. A grip 40 and a trigger 50 are assembled to the housing 30, a magazine 60 is disposed below the gun body 10, and an extension member 110 is connected to the gun body 10. The extension member 110 includes a bump 130 in an elongated shape and a plurality of retaining troughs 120 formed on the bump 130. The gun body 10 is, for example, an airsoft gun simulating M16 rifle; however, the present invention is not limited thereto, and the gun body 10 can also be an airsoft gun simulating a sniper rifle, a submachine gun, or other guns.

The buttstock structure 100 includes a buttstock body 200 and an adjusting trigger 300. When operating the adjusting trigger 300, the buttstock body 200 extends or retracts with respect to the extension member 110.

The adjusting trigger 300 includes a flat plate 322 connected to the handle 310 and two side plates 330 respectively connected to two sides of the flat plate 322, the two inclined slots 340 are respectively formed on the two side plates 330, the flat plate 322 is formed with a through hole 324 and a slide slot 326 communicating with the through hole 324. In the embodiment shown in FIG. 2, the buttstock structure 100 further includes a stopper pin 170 inserted in the buttstock body 200, and a limiting hole 332 disposed corresponding to the stopper pin 170 is formed on an upper edge of each of the side plates 330, wherein the movement of the adjusting trigger 300 is limited by the movement of the stopper pin 170 on the limiting hole 332. Furthermore, in the present embodiment, the buttstock structure 100 further includes a fixed pillar 180 integrally formed with the buttstock body 200, the through hole 324 of the adjusting trigger 300 encloses the fixed pillar 180, thereby making the flat plate 322 movable with respect to the fixed pillar 180 by means of the slide slot 326.

The buttstock body 200 further includes a chamber 210 accommodating the extension portion 110, a latch 220 selectively engaged with a respective one of the retaining troughs 120, and a latch recess 240 accommodating the latch 220. In the present embodiment, the chamber 210 preferably forms an indentation 212 corresponding to the bump 130, so that the buttstock body 200 can be assembled to the extension member 110 readily and accurately. In the embodiment shown in FIG. 2, a retaining pin 230 is inserted in the latch 220 and protrudingly disposed on a side wall of the latch recess 240. The adjusting trigger 300 is movably connected with the buttstock body 200, the adjusting trigger 300 includes a handle 310 and a linking member 320 connected to the handle 310. Two inclined slots 340 for containing the retaining pin 230 are formed at one end of the linking member 320. Two ends of the retaining pin 230 are disposed in the two inclined slots 340, respectively, as shown in FIG. 3.

In the present embodiment, the buttstock structure 100 further includes a fastener 150 limiting the latch 220 from movement and a resilient element 160 restoring the latch 220 to an original position, wherein the latch 220 includes a first latch hole 222 for insertion of the retaining pin 230, a first fastener hole 224 for insertion of the fastener 150, and an opening 226 for receiving the resilient element 160. The buttstock body 200 is formed with a second latch hole 244 and a second fastener hole 246 communicating with the latch recess 240, the second latch hole 244 and the first latch hole 222 are disposed correspondingly, the second fastener hole 246 and the first fastener hole 224 are disposed correspondingly, the first fastener hole 224 is longer than the first latch hole 222, the resilient element 160 is disposed between the retaining pin 230 and the fastener 150, and the second fastener hole 246 is shorter than the second latch hole 244. Accordingly, the fastener 150 positions the latch 220 to the second fastener hole 246, and the latch 220 is movable upward and downward resiliently along the first fastener hole 224.

Figure 4:
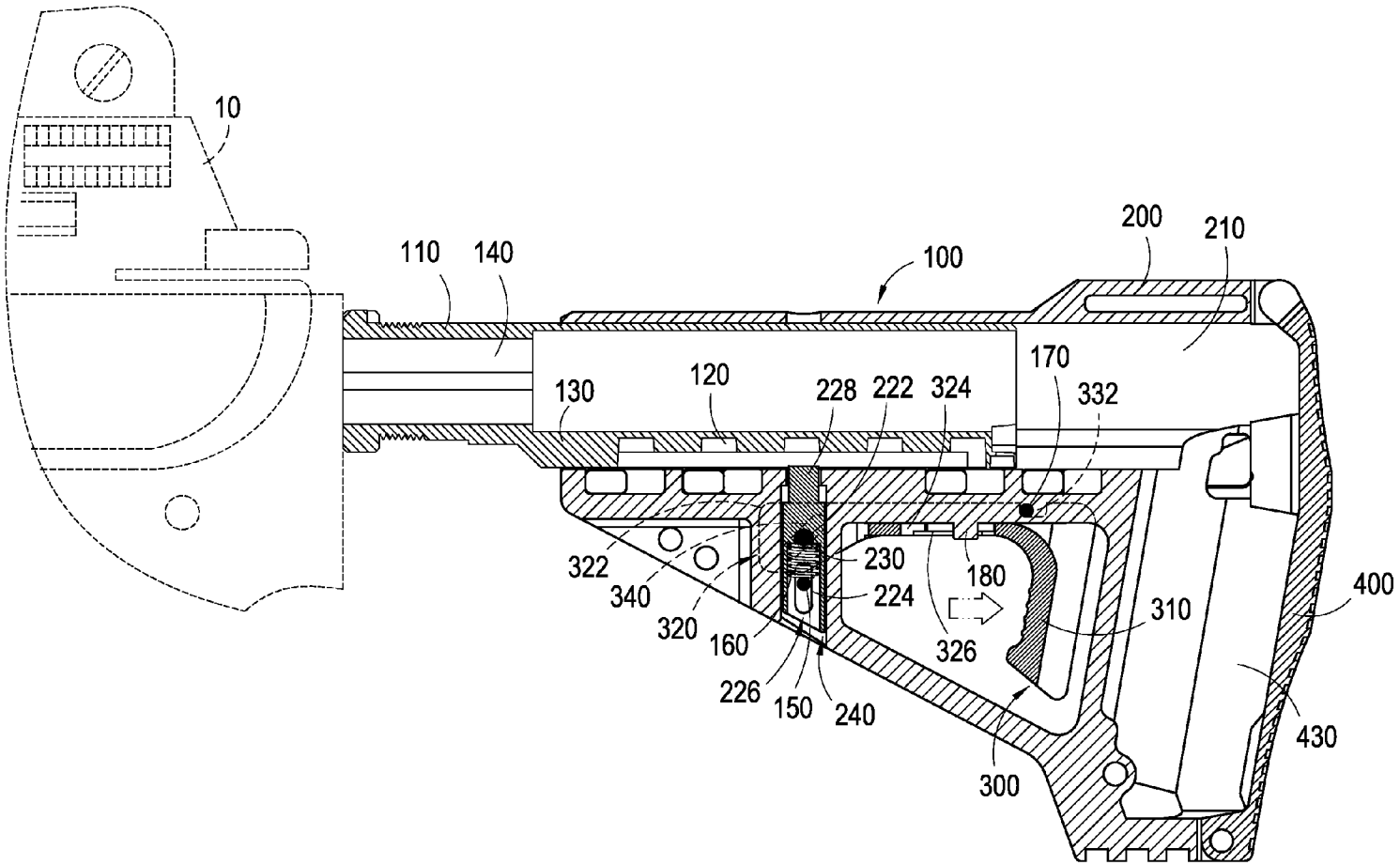
FIG. 4 is another operating view of FIG. 3.
Figure 5:
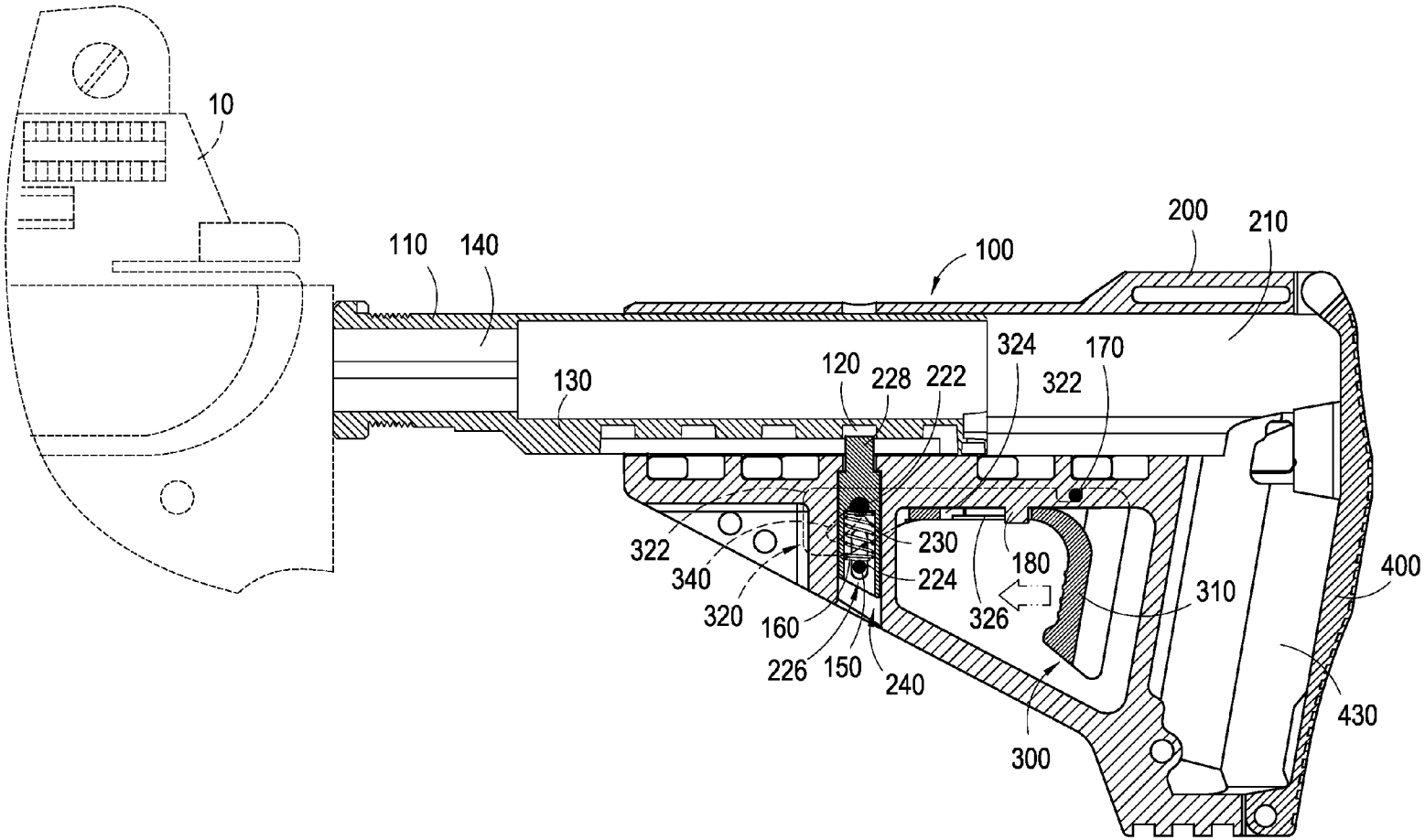
FIG. 5 is another operating view of FIG. 4.

Referring to FIGS. 3, 4, and 5, the latch 220 is positioned to the second latch hole 244 by means of the retaining pin 230 inserted into the second latch hole 244 through the first latch hole 222, and the latch 220 is movable upward and downward along the second latch hole 244 by a transverse movement of the inclined slot 340. Furthermore, when a player operates the adjusting trigger 300 to move it away from the latch 220 (i.e. moving it transversely to the right in the figures), the retaining pin 230 moves along the two inclined slots 340 to the bottom left thereof. At this point, the latch 220 is pressed by the retaining pin 230 to move in a direction opposite to the respective retaining troughs 120 (i.e. the latch 220 moves downward), and the pillar 228 of the latch 220 is removed from the retaining trough 120 of the extension member 110, as shown in FIGS. 3 and 4.

When the player continues to move the adjusting trigger 300 transversely, the buttstock body 200 is driven to move with respect to the extension member 110, so that a distance between the buttstock 200 and the gun body 10 is adjusted. After the player releases the adjusting trigger 300, the resilient element 160 which is preferably a compression spring is restored to restore the latch 220 to its original position, so the pillar 228 of the latch 220 is engaged with the retaining trough 120, as shown in FIG. 5. Therefore, by operating the adjusting trigger 300 to adjust a distance between the buttstock body 200 and the extension member 110, the buttstock structure 200 is easy to adjust in length for comfortable use of individuals of different size. In summary, the buttstock structure 100 of the present invention is a simple structure, and a length of the buttstock structure 200 can be adjusted easily and quickly.

Figure 6:
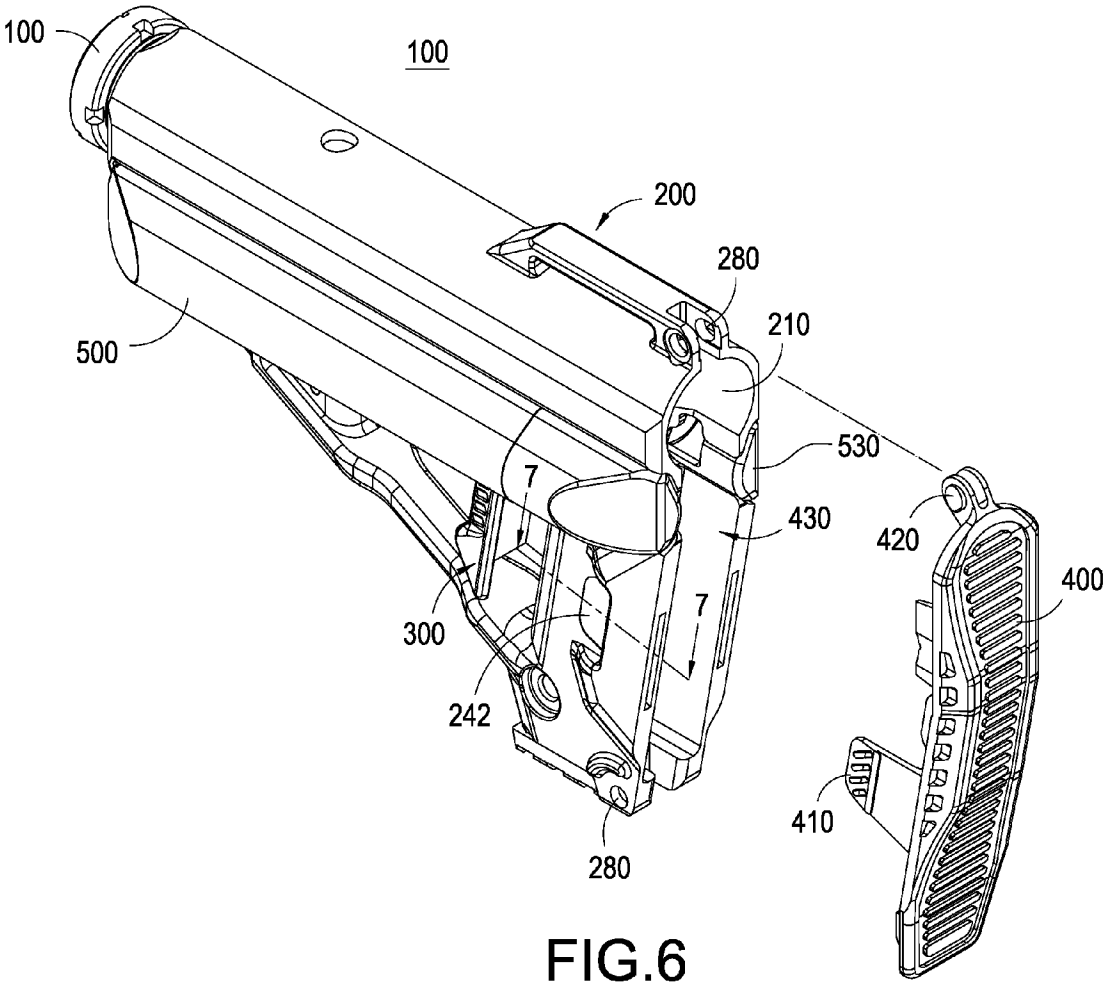
FIG. 6 is a perspective view of the present invention, showing a buttstock cover detached from the buttstock structure.
Figure 7B:
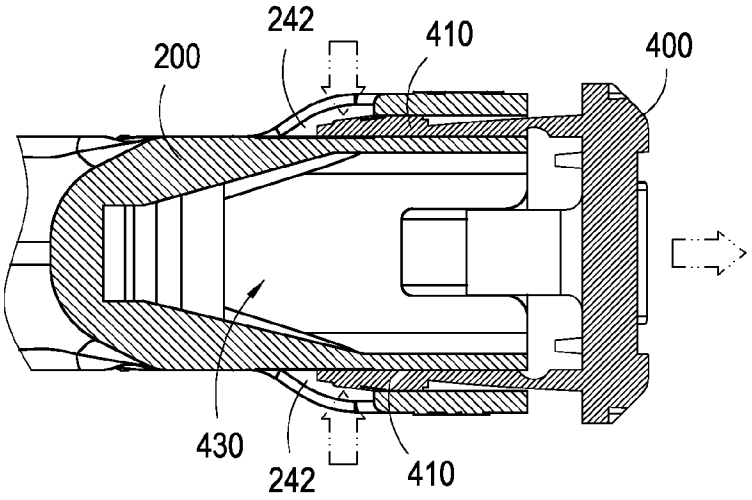
FIG. 7B is a cross-sectional view of the present invention, showing a press portion pressed to detach the buttstock cover from the buttstock body.
Figure 7A:
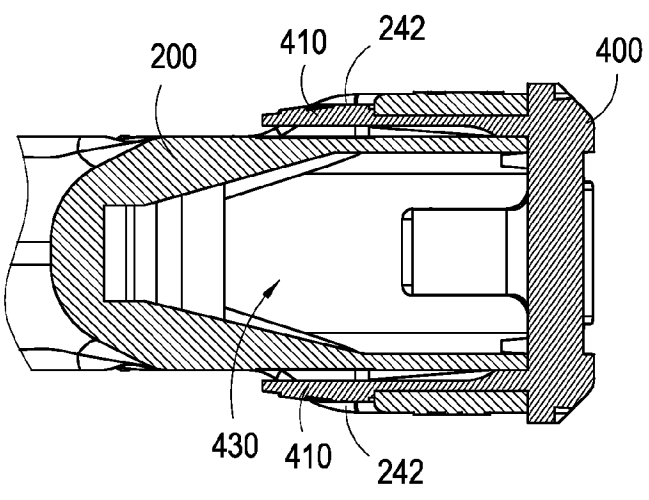
FIG. 7A is a cross-sectional view of the present invention, showing the buttstock cover assembled to the buttstock body.

Referring to FIG. 6, the present embodiment further includes a buttstock cover 400 disposed at one side of the buttstock body 200, wherein the buttstock body 200 includes two apertures 242 and at least one pivot hole 280. The buttstock cover 400 includes two press portions 410 and at least one pivot 420 rotatable with respect to the at least one pivot hole 280, wherein the two press portions 410 are movably connected to the two apertures 242. Referring to FIGS. 7A and 7B, an accommodating space 430 is formed between the buttstock body 200 and the buttstock cover 400, so as to receive a gas canister, a battery, a magazine, or other suitable objects. Thus, by pressing the two press portions 410, the two press portions 410 are detached from the two apertures 242, and then the buttstock cover 400 is rotatable around the pivot 420 as a center, thereby facilitating receiving or taking the objects in the accommodating space 430.

Figure 8:
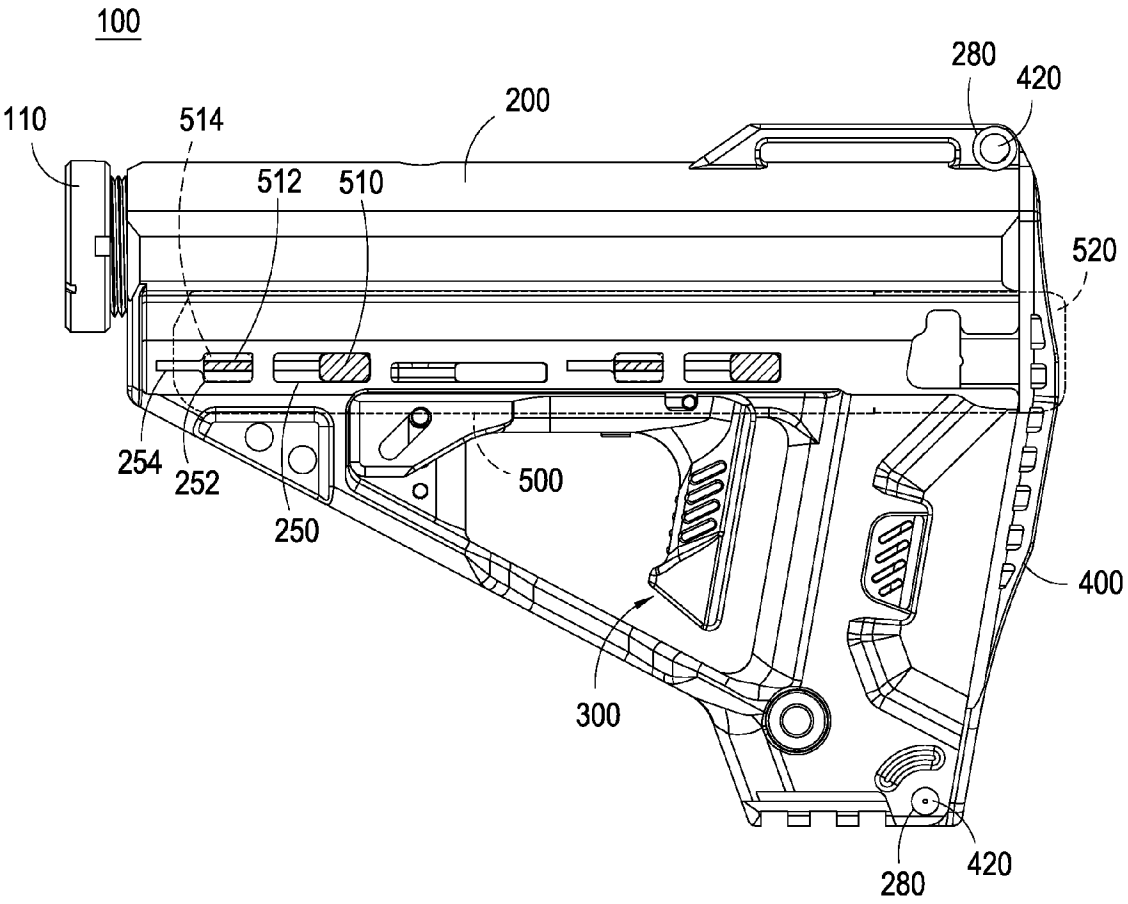
FIG. 8 is a schematic view of the present invention, showing a first carrier assembled to the buttstock body.
Figure 9:
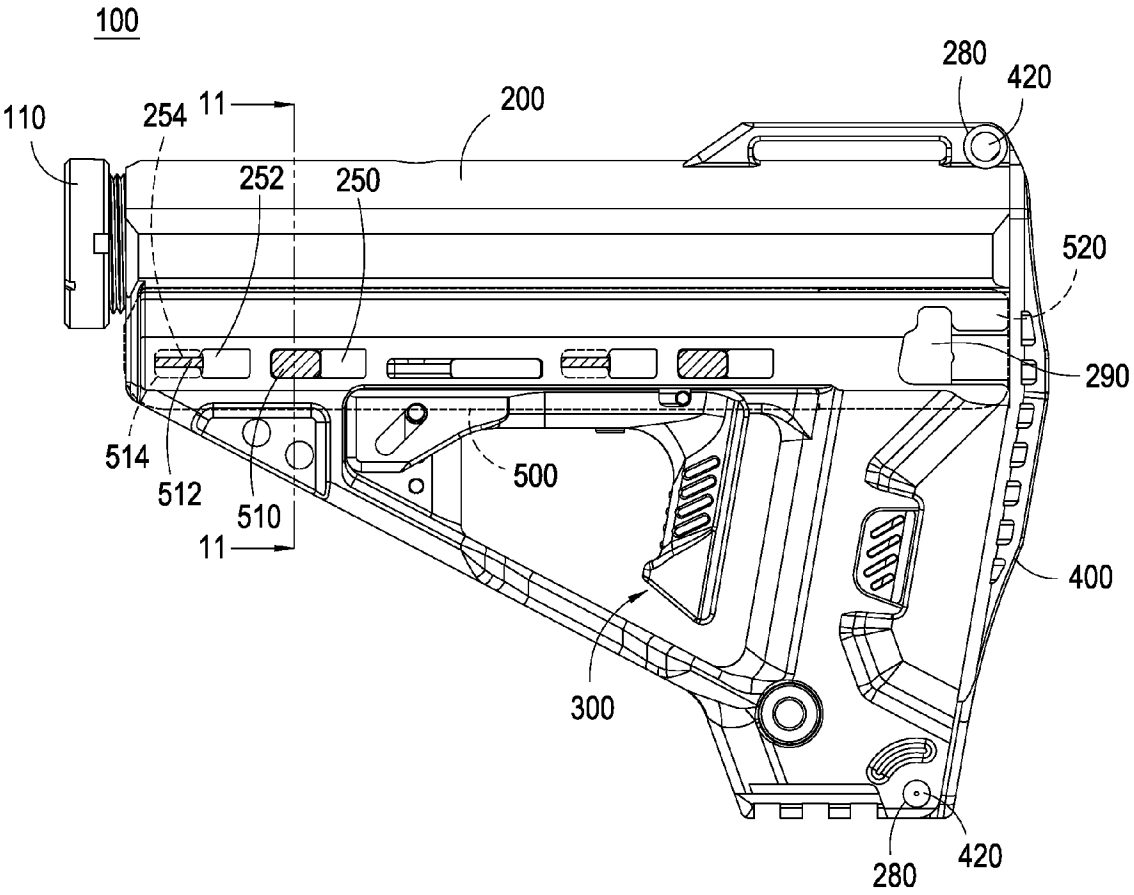
FIG. 9 is another operating view of FIG. 8.
Figure 10:
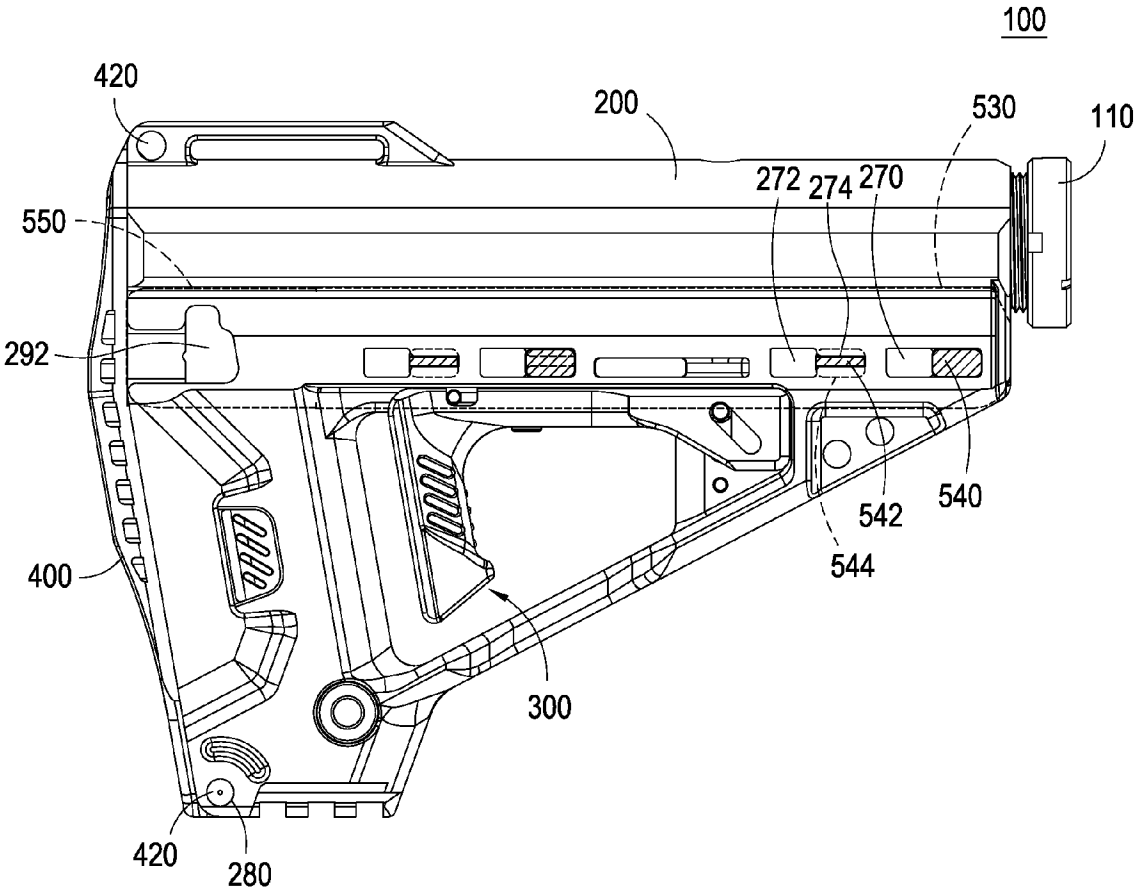
FIG. 10 is a schematic view of the present invention, showing the other side of the buttstock body.
Figure 11:
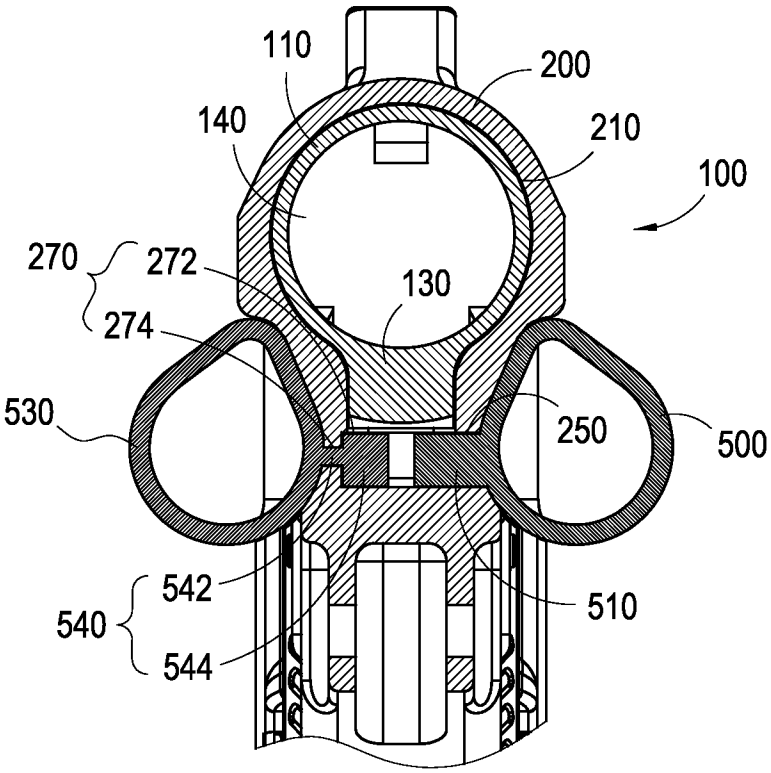
FIG. 11 is a cross-sectional view of FIG. 9.

Referring to FIG. 1 and FIGS. 8 to 11, the buttstock body 200 further includes a plurality of first engagement slots 250 and a plurality of second engagement slots 270 respectively disposed corresponding thereto. Referring to FIGS. 1, 9, and 10, the buttstock body 200 includes a first carrier 500 having a plurality of first blocks 510 and includes a second carrier 530 including a plurality of second blocks 540. The first carrier 500 is engaged with each of the first engagement slots 250 by means of each of the first blocks 510, and the second carrier 530 is engaged with the second engagement slots 270 by means of each of the second blocks 540. The first carrier 500 and the second carrier 530 are adapted to receive the batteries for a flashlight or an automatic electric gun, a glow stick, and etc. In the present embodiment, the first carrier 500 and the second carrier 530 are cylindrical, and the aforesaid objects are disposed inside an inner cylindrical space, but the present invention is not limited in this regard.

In the present embodiment, one end of each of a portion of the first engagement slot 250 forms a first engagement hole 252 and a first engagement trench 254 communicating with the first engagement hole 252, and each of a portion of the second engagement slots 270 forms a second engagement hole 272 and a second engagement trench 274 communicating with the second engagement hole 272. Each of a portion of the first blocks 250 includes a first neck portion 512 and a first head portion 514 connected to the first neck portion 512, each of a portion of the second blocks 540 includes a second neck portion 542 and a second head portion 544 connected to the second neck portion 542, the first head portion 514 is disposed corresponding to the first engagement hole 252, the second head portion 544 is disposed corresponding to the second engagement hole 272, the first neck portion 512 is engaged with the first engagement trench 254, and the second neck portion 542 is engaged with the second engagement trench 274.

Descriptions hereinafter relates to engaging the first carrier 500 with each first engagement slot 250 of the buttstock body 200. As to details about assembling the second carrier 530, please refer to the descriptions about the first carrier 500. Referring to FIGS. 8 and 9, it is preferable that the number of the first engagement slots 250 is four, and two of them each have the first engagement hole 252 and the first engagement trench 254, and the other two have a single size. Particularly, the first engagement slots 250 having the first engagement trench 254 and the single-sized first engagement slots 250 are disposed in a staggered manner. Therefore, when each first block 510 of the first carrier 500 is assembled to a respective one of the first engagement slots 250, each first block 510 is first assembled in a respective one of the first engagement holes 252, as shown in FIG. 8. When the first carrier 500 is moved transversely toward each first engagement trench 254, the first engagement block 510 having the first neck portion 512 is engaged in the first engagement trench 254, as shown in FIG. 9.

The first carrier 500 and the second carrier 530 preferably have an arc-shaped cross-section, so as to provide a comfortable contact with the face of each player. In addition, the first carrier 500 encloses a first casing 520, and the second carrier encloses a second casing 550. A first gap 522 is formed on one end of the first casing 520, a second gap 552 is formed on the second casing 550, and the buttstock body 200 is formed with a first recess 290 corresponding to the first gap 522 and is formed with a second recess 292 corresponding to the second gap 552. Accordingly, when the first carrier 500 or the second carrier 530 receives a battery of the automatic electric gun, a wire (not illustrated) connected to the battery of the automatic electric gun is inserted from the first recess 290 or the second recess 292 into the first gap 522 or the second gap 552 to be electrically connected to a motor (not illustrated) in the gun body 10. As shown in the figures, the first recess 290 and the second recess 292 communicate with the chamber 210 of the buttstock body 200.

In the embodiment shown in FIG. 10, the first engagement slots 250 and the second engagement slots 270 are disposed in a staggered pattern. In other words, the single-sized first engagement slot 250 is disposed corresponding to the second engagement slot 270 having the second engagement hole 272 and the second engagement trench 274. Furthermore, the first blocks 510 of the first carrier 500 are respectively disposed corresponding to the first engagement slots 250, and the second blocks 540 of the second carrier 530 are respectively disposed corresponding to the second engagement slots 270, so the present invention has a foolproof effect, and as a result, no assembling errors occur between the first carrier 500 and the second carrier 530.

What is claimed is:

1. A buttstock structure for a toy gun, for collaborating with a gun body, the gun body comprising an extension member connected to the gun body, the extension member being formed with a plurality of retaining troughs, the buttstock structure comprising:

a latch including a hollow cylindrical body, and a pillar protruding from one end of the hollow cylindrical body and selectively engaged with a respective one of the retaining troughs;

a buttstock body including a chamber accommodating the extension portion, and a latch recess accommodating the latch;

a retaining pin inserted in the latch and protrudingly disposed on a side wall of the latch recess;

a fastener inserted in the latch for limiting the latch from movement;

a resilient element disposed inside the hollow cylindrical body with two ends directly contacting with the retaining pin and the fastener, respectively, for restoring the latch to an original position; and an adjusting trigger movably connected with the buttstock body, the adjusting trigger including a handle and a linking member connected to the handle, two inclined slots for containing the retaining pin being formed at one end of the linking member, wherein when the adjusting trigger moves away from the latch along an extending direction of the extension member, the two inclined slots make the retaining pin move down to further drive the pillar of the latch to be removed from the retaining trough, and thereby the buttstock body is moved with respect to the extension portion.

2. The buttstock structure of claim 1, wherein the latch further includes a first latch hole for insertion of the retaining pin, a first fastener hole for insertion of the fastener, and an opening at an opposite end of the hollow cylindrical body for receiving the resilient element to be disposed inside the hollow cylindrical body.

3. The buttstock structure of claim 2, wherein the buttstock body is formed with a second latch hole and a second fastener hole communicating with the latch recess, the second latch hole and the first latch hole are disposed correspondingly, the second fastener hole and the first fastener hole are disposed correspondingly, the first fastener hole which is a slot hole is longer than the first latch hole which is a round hole, the resilient element is disposed between the retaining pin and the fastener, and the second fastener hole which is another round hole is shorter than the second latch hole which is another slot hole.

4. The buttstock structure of claim 1, wherein the adjusting trigger includes a flat plate connected to the handle and two side plates respectively connected to two sides of the flat plate, the two inclined slots are respectively formed on the two side plates, and the flat plate is formed with a through hole and a slide slot communicating with the through hole.

5. The buttstock structure of claim 4, further comprising a stopper pin inserted in the buttstock body, a limiting hole disposed corresponding to the stopper pin being formed on an upper edge of each of the side plates, wherein the movement of the adjusting trigger is limited by the movement of the stopper pin on the limiting hole.

6. The buttstock structure of claim 4, further comprising a fixed pillar integrally formed with the buttstock body, the through hole of the adjusting trigger enclosing the fixed pillar, thereby making the flat plate movable with respect to the fixed pillar by means of the slide slot.

7. The buttstock structure of claim 1, further comprising a buttstock cover disposed at one side of the buttstock body, the buttstock body including two apertures and at least one pivot hole, the buttstock cover including two press portions and at least one pivot being rotatable with respect to the at least one pivot hole, the two press portions being movably connected to the two apertures.

8. The buttstock structure of claim 7, wherein an accommodating space is formed between the buttstock body and the buttstock cover.

9. The buttstock structure of claim 1, wherein a plurality of first engagement slots and a plurality of second engagement slots respectively disposed corresponding thereto are formed at two sides of the buttstock body.

10. The buttstock structure of claim 9, further comprising a first carrier including a plurality of first blocks and a second carrier including a plurality of second blocks, the first carrier being engaged with each of the first engagement slots by means of each of the first blocks, the second carrier being engaged with the second engagement slots by means of each of the second blocks.

11. The buttstock structure of claim 10, wherein each of the first engagement slots and each of the second engagement slots are disposed in a staggered pattern, a portion of the first engagement slot forms a first engagement hole and a first engagement trench communicating with and extending along the extending direction from the first engagement hole, and a portion of the second engagement slot forms a second engagement hole and a second engagement trench communicating with and extending along the extending direction from the second engagement hole.

12. The buttstock structure of claim 11, wherein a portion of the first block includes a first neck portion and a first head portion connected to the first neck portion, a portion of the second block includes a second neck portion and a second head portion connected to the second neck portion, and for engaging the first carrier and the second carrier with the buttstock body, the first head portion is disposed corresponding to the first engagement hole, and the second head portion is disposed corresponding to the second engagement hole, then sliding the first carrier and the second carrier along the extending direction so that the first neck portion is engaged with the first engagement trench, and the second neck portion is engaged with the second engagement trench.

13. The buttstock structure of claim 10, wherein the first carrier encloses a first casing, and the second carrier encloses a second casing.

14. The buttstock structure of claim 13, wherein a first gap is formed on one end of the first casing, a second gap is formed on the second casing, and the buttstock body is formed with a first recess corresponding to the first gap and is formed with a second recess corresponding to the second gap.

15. The buttstock structure of claim 10, wherein the first carrier and the second carrier have an arc-shaped cross-section.

* * * * *